US006793073B2

(12) United States Patent
Tu

(10) Patent No.: US 6,793,073 B2
(45) Date of Patent: Sep. 21, 2004

(54) METHOD AND DEVICE FOR PACKAGING A WINDOW BLIND

(76) Inventor: Kevin Tien-Jen Tu, 8241 Keele Street, Units 3&4, Concord, Ontario (CA), L4K 1Z5

( * ) Notice: Subject to any disclaimer, the term of this patent is extended or adjusted under 35 U.S.C. 154(b) by 219 days.

(21) Appl. No.: 10/077,863

(22) Filed: Feb. 20, 2002

(65) Prior Publication Data

US 2003/0155258 A1 Aug. 21, 2003

(51) Int. Cl.[7] ..... B65D 85/00

(52) U.S. Cl. ..... 206/320; 206/443; 206/326; 206/525; 206/446

(58) Field of Search ..... 206/422, 446, 206/443, 321, 326, 525, 388, 576, 320, 315.11, 525.1, 593, 594

(56) References Cited

U.S. PATENT DOCUMENTS 2,090,780 A * 8/1937 Bonville ..... 229/199
2,277,674 A * 3/1942 Russell ..... 229/122.33
2,790,588 A * 4/1957 Deeren ..... 206/521
2,975,888 A * 3/1961 Paynton, Sr. ..... 206/771
3,421,839 A * 1/1969 Ward ..... 422/120
3,618,848 A * 11/1971 Pawlowski et al. ..... 206/784
3,678,611 A * 7/1972 Files ..... 43/26
4,314,638 A * 2/1982 Gordon et al. ..... 206/427
4,858,366 A * 8/1989 Rushton ..... 43/26
4,979,614 A * 12/1990 Ruhaut ..... 206/702
6,390,296 B1 * 5/2002 Griffith et al. ..... 206/320

* cited by examiner

*Primary Examiner*—Jila M. Mohandesi
(74) *Attorney, Agent, or Firm*—David W. Wong

(57) ABSTRACT

A window blind is mounted within a rectangular box having two opposite opened ends. The box has a longitudinal length shorter than the width of the window blind such that two end portions of the blind extend beyond the opened ends of the box respectively. Spacers are provided by tabs integrally formed on top and bottom panels of the box, which are foldable downward inwardly to locate between the slats and the head rail of the blind. The spacers press the slats and the head rail respectively tightly against the side panels of the box, and they also provide the required space for locating the end portions of the slats and the head rail in the cutting means of a trimming machine for trimming the window blind to a desirable width.

4 Claims, 4 Drawing Sheets

FIG. 8
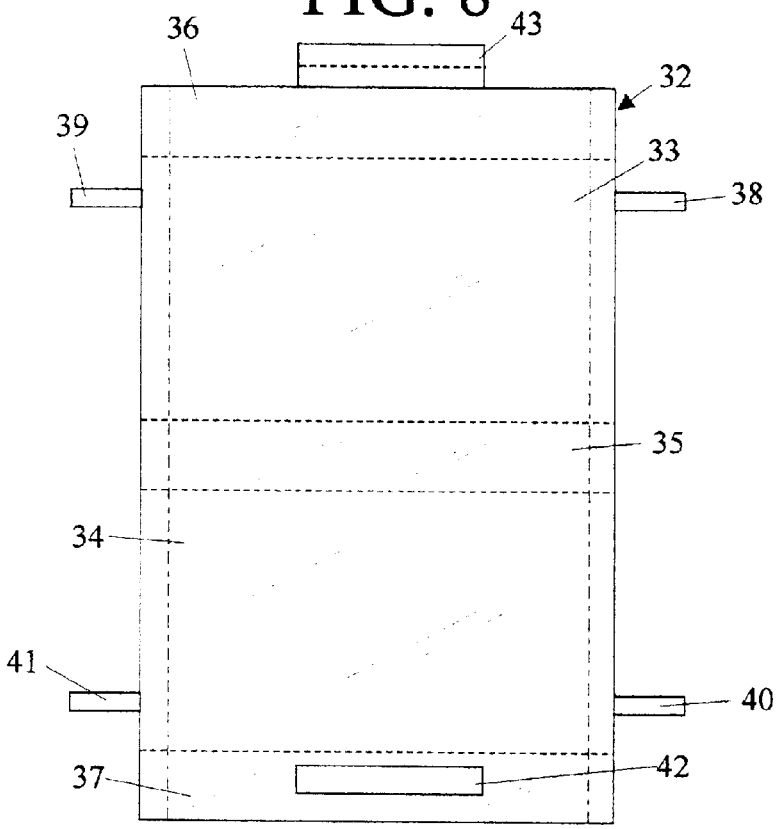
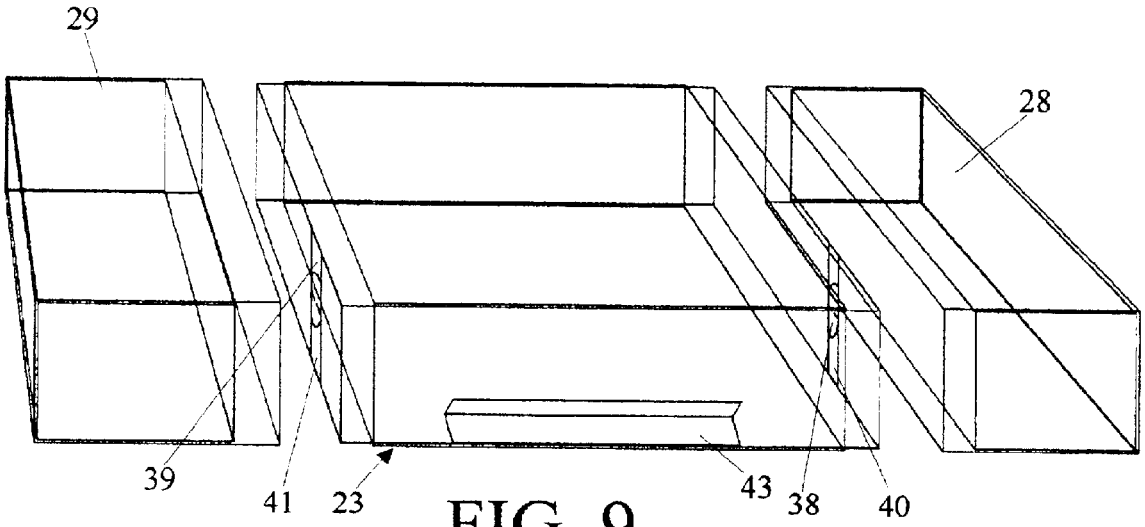
FIG. 9

METHOD AND DEVICE FOR PACKAGING A WINDOW BLIND

FIELD OF INVENTION

This invention relates to a method and device for packaging a window blind and more particularly relates to a method and device for packaging a horizontal window blind to facilitate trimming of the blind to a custom width.

BACKGROUND OF THE INVENTION

A blind provides a pleasing, clean, and carefree covering for a window. A horizontal blind consists of a plurality of slats mounted between a horizontal head rail and a horizontal bottom rail. A ladder cord or tape system linking between the head rail, the slats and the bottom rail, provides the means of suspending the slats between the head rail and the bottom rail to cover over the window opening or to be raised to uncover the window opening. The ladder cord or tape system is mounted to a rotatable bar located in a channel in the head rail. A pull cord is threaded through the slats and connected to the bottom rail such that it is operative to raise or lower the blind; and a tilt rod is provided for orienting the slats in a desired vertical angle.

Window blinds are fabricated in standard stock sizes for covering common sizes of window openings. However, due to the large variety of window opening sizes, it is necessary to trim a blind to fit perfectly over, particularly the width, of the window. Normally, the trimming is accomplished by placing the blind on a horizontal supporting platform of a trimming machine which has a shearing mechanism for cutting off excess portions from its two ends so as to trim it to the custom width. The head rail and the bottom rail may be made of the same material as the slats or of a different material and may be cut by either a similar shearing knife mechanism or a separate cutting saw provided on the trimming machine. The blind must be firmly mounted and secured on the trimming machine platform for the trimming operation.

It has been problematic in the mounting operation of the blind on the trimming machine. This is due to that the blind is packaged in a container and it must first be completely removed from the container for placing it on the supporting platform of the trimming machine for the trimming operation. Since the head rail, the slats and the bottom rail are merely linked or tied together by the ladder cord or tape system, they are movable relative to one another. Therefore, it is rather awkward to locate them securely in a compact manner on the trimming machine platform for carrying out the trimming operation. The operation is further complicated by having to space the head rail and the bottom rail from the slats for them to be cut by separate cutting means particularly when the head rail and the bottom rail are made of a different material than the slats. Moreover, the blind after having been trimmed must then be placed back into the packaging container. Such unpackaging and repackaging operations are awkward and often frustrating to carry out.

BRIEF SUMMARY OF THE INVENTION

It is a principal object of the present invention to provide a method and a device for packaging a window blind for merchandising as well as to provide the means for positioning and securing it expeditiously and easily on a trimming machine for its trimming operation.

It is another object of the present invention to provide a method and device which requires no repackaging of the window blind after trimming.

It is another object of the present invention to provide a device for packaging a window blind which provides the necessary spacing between the head rail and the slats and between the bottom rail and the slats to facilitate positioning its ends on the trimming machine for the trimming operation.

It is still another object of the present invention to provide a packaging device which is simple in structure and easy to use.

BRIEF DESCRIPTION OF THE DRAWINGS

Other objects of this invention will appear in the following description and appended claims, references being made to the accompanying drawings in which

FIG. 8 is a perspective front elevation view of the board for forming the binding box of the container of FIG. 6 in an unfolded form.

FIG. 9 is a perspective exploded elevation of the container with the binding box in a folded form.

DETAILED DESCRIPTION OF THE PREFERRED EMBODIMENTS

Figure 1:
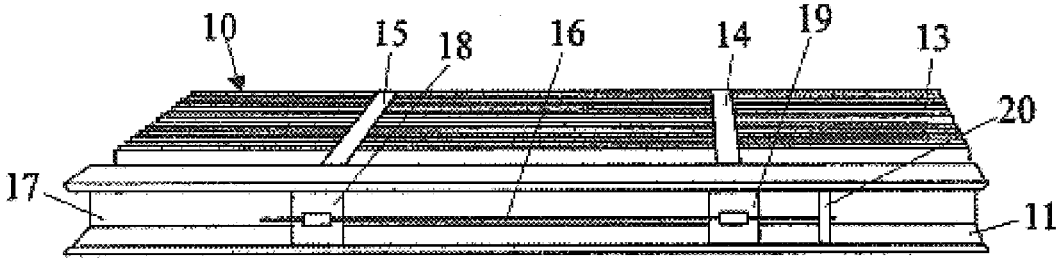
FIG. 1 is a perspective top elevation view of a window blind showing the rotatable bar located in a head rail having a U-shaped cross section and a ladder tape system tying the slats to the head rail.
Figure 2:
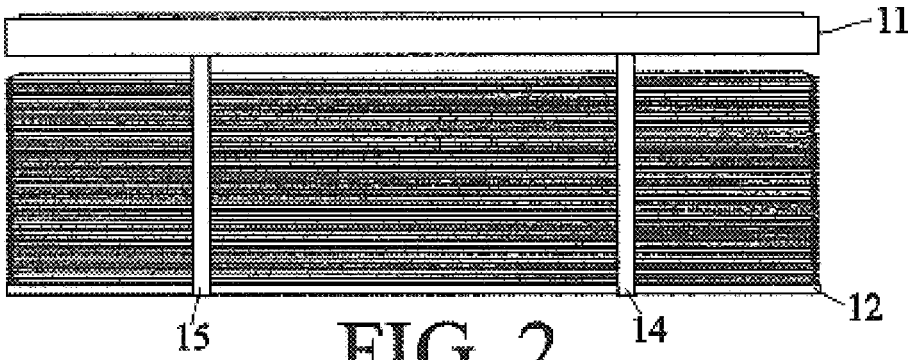
FIG. 2 is a perspective front elevation view of the blind of FIG. 1.
Figure 3:
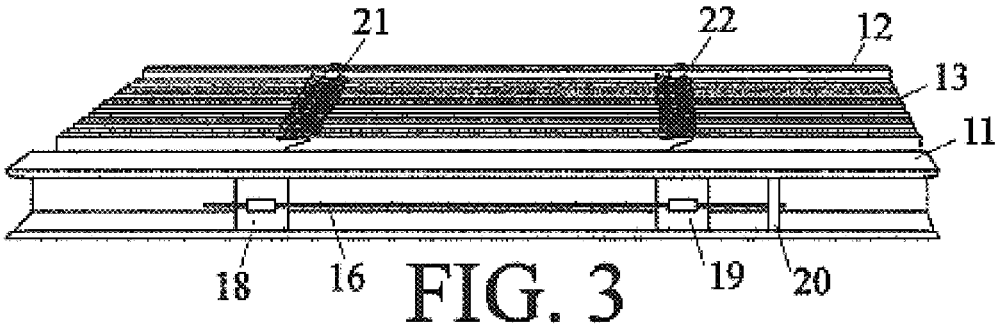
FIG. 3 is a perspective top elevation of a window blind similar to that of FIG. 1 and provided with a ladder cord system for tying the slats to the head rail.
Figure 4:
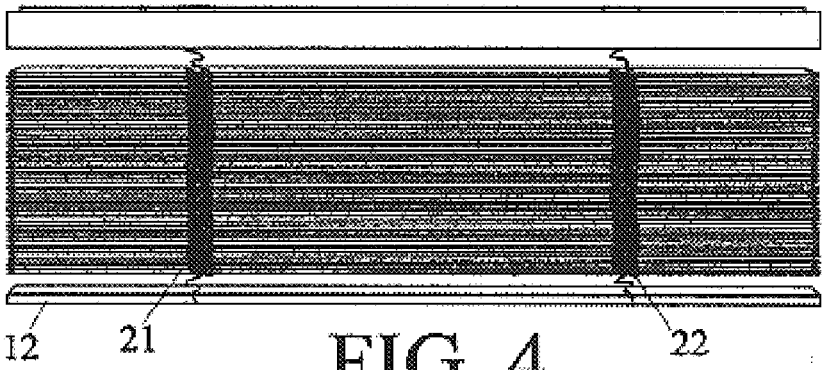
FIG. 4 is a perspective front elevation view of the blind of FIG. 3.

With reference to the drawings in which like reference numerals designate corresponding parts in the several views, a horizontal window blind 10 is shown in FIGS. 1 and 2. The blind consists of a head rail 11 in the form of channel bar having a U-shaped cross section and a bottom rail 12. A plurality of thin slats 13 are linked or tied to the head rail 11 and bottom rail 12 by two parallel vertical ladder tape arrangements 14 and 15 such that the slats 13 may be suspended from the head rail 11 to cover over a window opening. The ladder tape arrangements 14 and 15 is coupled to a rotatable shaft 16 located in the channel 17 of the head rail. The rotatable shaft 16 is rotatable relative to its supports 18 and 19 by a rotary bar(not shown) coupled to the rotatable shaft 16 by a gear system mounted to the rotatable shaft such that the rotary bar may be operative for adjusting the horizontal angle of the slats 13. The bottom rail 12 is connected to a pull cord(not shown) threaded through the slats 13 such that the pull cord may be operated to raise or lower the blind. As best shown in FIGS. 3 and 4, two ladder cord arrangements 21 and 22 may be provided instead of the ladder tape arrangements 14 and 15 for the same purposes. The slats 13 are commonly made of plastic, metal or wood while the head rail 11 and bottom rail 12 are made of plastic or metal.

In order to custom fit the width of the blind to a window opening, equal portions of the two end portions of a blind wider in width than the window opening are cut to provide the desired dimensions. The cutting or trimming is carried out by a trimming machine having a shearing knife operative for cutting the slats held in a compacted mass. The head rail 11 and the bottom rail 12 are necessarily cut by a separate shearing knife or saw. Trimming machines such as that shown in U.S. Pat. No. 5,339,761 to J. L. Sands and U.S. Pat. No. 6,089,134 to N. Marocco may be used for such purposes. The trimming operation is carried out by the retailer of the blind in order to eliminate the time required for shipping it back and forth from the manufacturer for the trimming operation so that the blind may be provided to the customer quickly. However, since the blind is packaged in a container for merchandising when it is supplied to the retailer by the manufacturer, it must necessarily be removed by the retailer from its packaging in order to place it on the trimming machine for the trimming operation. As the head rail, bottom rail and slats are only loosely tied together by the ladder tape or cord arrangements they are movable relative to one another; it is therefore clumsy and frustrating to handle and to locate the blind securely on the trimming machine for the cutting operation. Because in order to carry out the cutting operation with the desirable accuracy, the slats 13 must be arranged orderly and clamped rigidly in a compacted fashion, and the head rail and bottom rail must also be secured firmly in place with a requisite spacing provided between it and the compacted mass of slats in order to position these different component parts properly with the cutting means of the trimming machine for trimming its end portions, due to the looseness of the parts relative to one another this procedure is irksome to carry out. Furthermore, after one end has been cut, it is necessary to turn the blind around to repeat the entire procedure for trimming the other end portion. Thus, the trimming procedure is rather frustrating and difficult to carry out, and often due to improper positioning and securement of the blind on the trimming machine it results in the unsatisfactory trimming of the blind. It is also problematic to remove the blind from its packaging container and than having to repackaging it in the same container before and after the trimming operation because of the relative movement between the head rail, the slats and the bottom rail as well as among the slats themselves.

Figure 5:
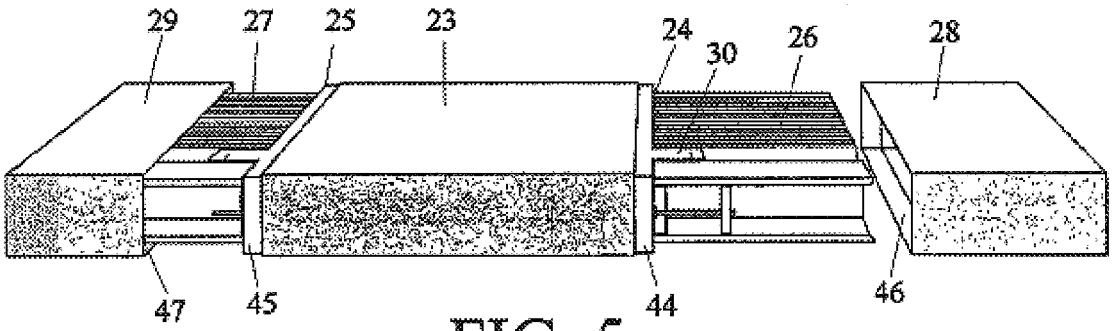
FIG. 5 is a perspective front elevation view of the container for packaging the blind according to the present invention.
Figure 11:
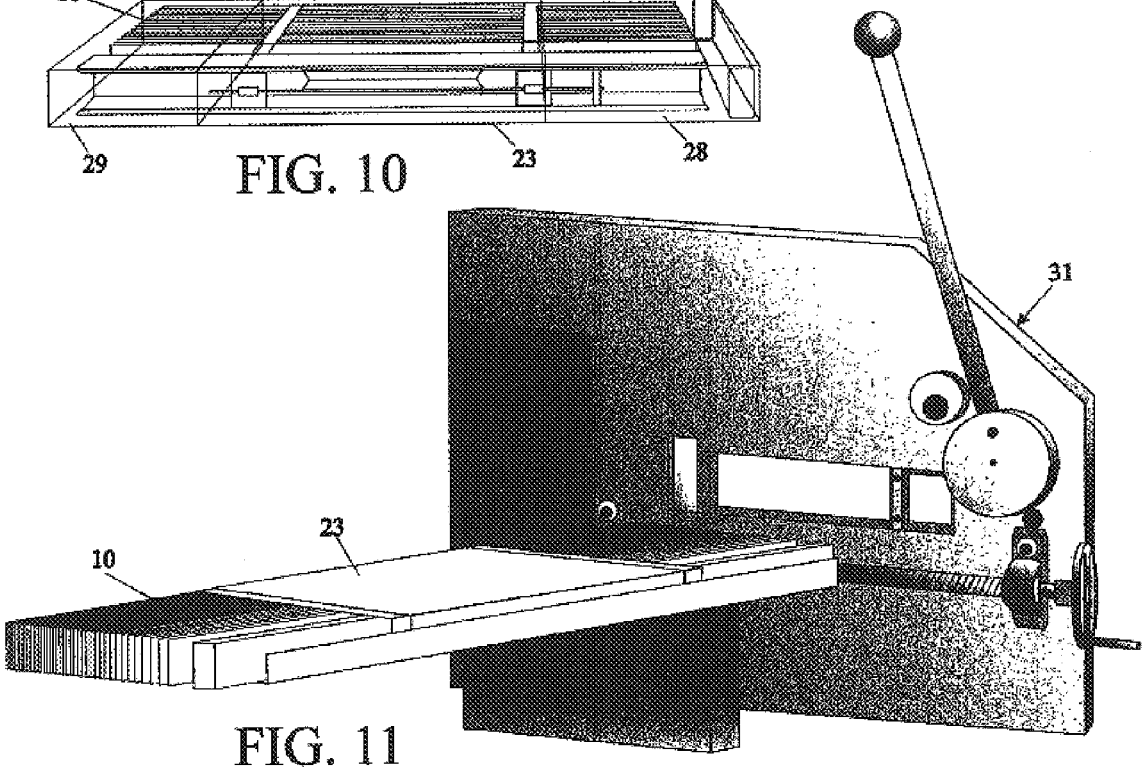
FIG. 11 is a perspective front elevation of the trimming machine with the blind packaged according to the present invention located on its supporting platform for the trimming operation.

The above problems are mitigated by the present invention as best shown in FIG. 5, by packaging the blind 10 in a container 23 which may be in the form of a rectangular box having two opened ends 24 and 25. The container 23 has a longitudinal length shorter than the width of the blind 10 such that the two end portions 26 and 27 of the blind 10 would extend outwards from the container 23 respectively when it is inserted into the latter. Two protective caps 28 and 29 are provided for covering the end portions 26 and 27 of the blind 10 normally during transportation or storage. A spacer 30 is placed between the head rail 11 and the slats 13 in order to provide the spacing required between them for locating their ends properly with the separate cutting means of the trimming machine. The spacer also serves to press the slats 13 in a compacted fashion tightly against the side wall of the container 23 to maintain them in place securely and orderly. By packaging the blind in such a container, the blind package may be easily and expeditiously placed on the trimming machine 31, as shown in FIG. 11, for trimming the blind by merely removing the end caps 28 and 29 respectively without requiring to remove the blind completely from the container or having to arranging the loosely fitted parts orderly for clamping them securely on the trimming machine as required presently. With the present invention, after one end portion has been trimmed, the package may simply be turned around for trimming the other end portion. It is not required to remove the blind from the packaging and repackaging it before and after the trimming operation.

Figure 6:
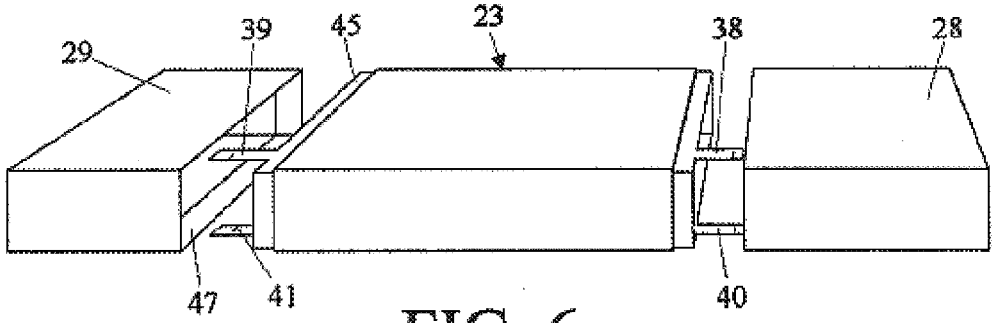
FIG. 6 is a perspective front exploded elevation view of an alternative embodiment of the container for packaging the blind according to the present invention.
Figure 7:
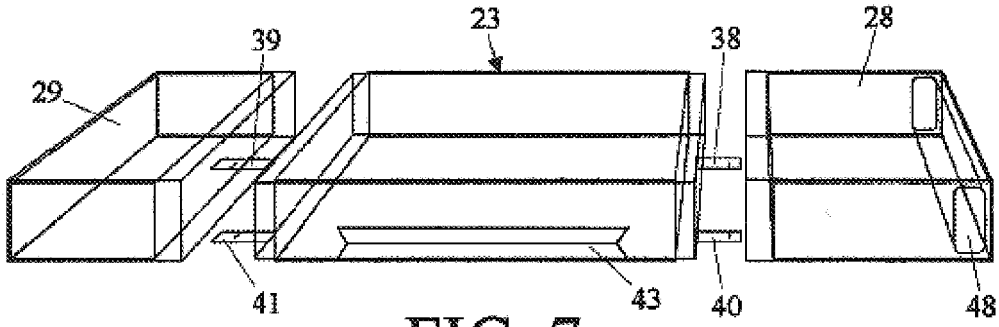
FIG. 7 is a perspective front exploded elevation view of the container of FIG. 6.
Figure 10:
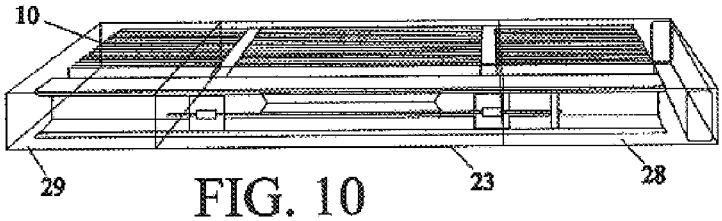
FIG. 10 is a perspective exploded elevation of the container of FIG. 9 with the window blind located in the binding box.

An alternative embodiment of the container 23 is shown in FIGS. 6, 7 and 9. In this embodiment, the container 23 may be formed by a generally rectangular shape cardboard or corrugated board 32 having a configuration as shown in FIG. 8. The board 32 has two rectangular portions 33 and 34, and a narrow rectangular middle portion 35 located between them. A top rectangular end portion 36 and a bottom rectangular end portion 37 are located at the top and bottom of the board. The middle portion 35 and the top end portion 36 and bottom portion 37 are equal in size. The board 32 may be folded along the fold lines between the various portions to form the container 23 with its rectangular portions 33 and 34 forming the top and bottom side panels and the middle portion 35 and bottom portion 37 forming the rear and front side panels of the container 23 respectively. Two tabs 38 and 39 are formed at the two sides of the rectangular portion 33 and located directly opposite to one another, and two similar tabs 40 and 41 are formed at the two sides of the rectangular portion 34 and are located also directly opposite to one another. The tabs 38, 39, 40 and 41 are located such that when the board 32 is folded to form the container 23, the tabs 38 and 40 are located directly opposite to one another, and tabs 39 and 41 are also located directly opposite to one another. The tabs 38 and 40 may be folded downward inwardly to join or overlap with each other, similarly the tabs 39 and 41 may also be folded downward inwardly to join or overlap with each other, so as to form the spacer required for providing the spacing between the compacted slats and the head rail, after the blind has been placed into the container 23. Also, the folded tabs will firmly push the head rail 11 against the side wall of the container as well as pressing the compacted slats against the other side wall so as to maintain the slats and the head rail and the bottom rail packed firmly in place within the container 23. The width of the board 32 is shorter than the width of the blind such that the two end portions of the blind 26 and 27 will extend beyond the open ends of the container 23. An elongated slot 42 is formed at the bottom middle portion of the rectangular portion 37, and an elongated tongue 43 is formed at the upper edge portion of the rectangular portion 36. The length of the elongated tongue 43 and the slot 42 is equal to the distance between the supports 18 and 19 of the rotatable bar 16 in the head rail 11. After the blind has been placed into the container 23, the upper rectangular portion 36 may be folded downwards to insert the tongue 43 into the slot 42 of the bottom rectangular portion 37 so that the tongue 43 will be located in the space between the supports 18 and 19 of the rotatable bar 16 to abut these supports so as to prevent any sliding movement of the blind relative to the container 23. In this manner, the blind 10 is firmly and securely held in position in the container 23 and is suitable for the trimming operation. An additional spacer as described above embodiment may also be provided to ensure all the component parts of the blind are firmly secured by the container 23.

Although four tabs 38, 39, 40 and 41 are formed in the top panel and the bottom panel of the box 23 as shown in the above preferred embodiments, it will be appreciated by those skilled in the art that alternatively only two tabs may be formed on either the top panel 33 or the bottom panel 34, or one tab formed at one side edge of either panels and another tab formed on the opposite edge of the other panel to serve the same purposes.

Extended lip portions 44 and 45 are formed at the two ends of the container 23 and recessed lip portions 46 and 47 are formed at the edge portions of the removable caps 28 and 29 respectively. The recessed lip portions 46 and 47 will engage snugly with the extended lip portions 44 and 45 respectively to maintain the removable caps 28 and 29 in place when the caps are mounted to the container 23.

A box 48 may be provided in one or both of the removable caps 28 and 29 for holding various small accessories and parts of the blind.

Obviously, numerous modifications and variations of the present invention are possible in light of the above teachings. It is therefore to be understood that within the scope of the appended claims, the invention may be practiced otherwise than as specifically described herein.

What I claim is:

1. A system of packaging a window blind comprising a window blind having a plurality of slats, a head rail, and a bottom rail tied together with a rope system, a substantially rectangular box having a length shorter than the width of said window blind to be mounted therein, said box having two opened ends, and said window blind in a collapsed condition being located within said box with two end portions of said window blind extending beyond said opened ends, said box having a top panel and, a bottom panel, one side panel adapted to juxtapose with one side of said slats, and a second side panel adapted to juxtapose with said head rail, a first tab formed at a first side edge of said top panel of said box and located spaced from said one side panel, a second tab formed at a second side edge of said bottom panel and located directly opposite to said first side edge of said top panel of said tab, said first tab and said second tab being folded inwards to engage with one another to form a spacer between said slats and said head rail for urging said slats against said one side panel and as well as pressing said head rail tightly against said second side panel for maintaining said window blind tightly mounted in said box.

2. A system of packaging a window blind whereby said window blind is trimmable to a selected width without having to remove from the packaging, comprising a window blind having a plurality of slats, a head rail, and a bottom rail tied together with a rope system, a rectangular box having two opposite opened ends and a longitudinal length shorter than the width of said window blind, and being operative to receive said window blind in a collapsed condition being located within said box with two end portions of said window blind extending beyond said opened ends respectively, said rectangular box having a top panel, a bottom panel, and two side panel wherein one side panel is adapted to juxtapose with one side of said slats, and a second side panel is adapted to juxtapose with said head rail, a first tab formed at one side edge of said top panel and located spaced from said one side panel, a second tab formed at another side edge opposite to said one side edge of said top panel and located spaced from said one side panel, a third tab formed at one side edge of said bottom panel and located directly opposite to said first tab, a fourth tab formed at another side edge opposite to said one side edge at said bottom panel and located directly opposite to said second tab, said first tab and said third tab being folded to engage with one another to form a first spacer for pressing said slats and said head rail tightly against opposite side panels of said box, said second tab and said fourth tab being folded to engage with one another to form a second spacer for additionally pressing said slats and said head rail tightly against said opposite side panels of said box, two end caps removably mounted at said opened ends of said box.

3. A system according to claim 3 including an elongated slot formed in a first side panel, said first side panel having a foldable flap, and an elongated tongue formed on a free edge of said flap and being inserted through said elongated slot to extend within said box and located between two supports of a rotatable shaft mounted in a channel of said head rail.

4. A system according to claim 3 including an extended edge lip portion formed at said opened ends of said box, and a recessed edge lip portion formed in said end caps, said extended edge lip portion and said recessed edge lip portion engaging with one another for maintaining said end caps securely mounted to said box.

* * * * *